United States Patent [19]

Kourinsky et al.

[11] Patent Number: 4,998,086

[45] Date of Patent: Mar. 5, 1991

[54] FUSE ASSEMBLY AND METHOD OF MANUFACTURE

[75] Inventors: Friedrich A. J. Kourinsky, Bensheim; Paul E. Romak, Langen; Guenter Siegel, Niederdorffelden, all of Fed. Rep. of Germany

[73] Assignee: AMP Incorporated, Harrisburg, Pa.

[21] Appl. No.: 368,737

[22] Filed: Jun. 20, 1989

[30] Foreign Application Priority Data

Sep. 8, 1988 [GB] United Kingdom ..... 8818905
Sep. 8, 1988 [GB] United Kingdom ..... 8818904

[51] Int. Cl.[5] ..... H01H 85/22; H01H 85/143
[52] U.S. Cl. ..... 337/255; 337/264
[58] Field of Search ..... 337/255, 264

[56] References Cited

U.S. PATENT DOCUMENTS

| | | | |
|---|---|---|---|
| 3,909,767 | 9/1975 | Williamson et al. | 337/264 |
| 4,344,060 | 8/1982 | Ciesemier et al. | 337/255 |
| 4,672,352 | 6/1987 | Takano | 337/264 |

FOREIGN PATENT DOCUMENTS

| | | | |
|---|---|---|---|
| 2940607 | 4/1981 | Fed. Rep. of Germany | 337/255 |
| 2946093 | 5/1981 | Fed. Rep. of Germany . | |
| 2422250 | 3/1979 | France . | |
| 2491255 | 9/1980 | France . | |

OTHER PUBLICATIONS

European Standard Search Report, 2/06/89.
Annex to Standard Search Report, 5/24/89.

*Primary Examiner*—Steven L. Stephan
*Assistant Examiner*—Nilay H. Vyas
*Attorney, Agent, or Firm*—Bruce J. Wolstoncroft

[57] ABSTRACT

An electrical fuse assembly has a dielectric housing and a fuse terminal which is stamped and formed from metal stock having the appropriate electrical characteristics. The fuse terminal has blade portions which are made from metal stock which has been folded over, to provide the blade portions with the strength characteristics required. Support members are also provided on the fuse terminal. The support members cooperate with cooperation surfaces to insure that the fuse terminal is properly positioned in the housing of the assembly. During the manufacture of fuse assembly a positioning bar extends between respective conductors. The positioning bar provides the structural support required to insure that the conductors are maintained in space relationship. After the conductors are partially inserted into the housing, a portion of the positioning bar is removed to provide a stop means which cooperates with the housing of the fuse assembly.

6 Claims, 3 Drawing Sheets

FUSE ASSEMBLY AND METHOD OF MANUFACTURE

The invention relates to electrical fuses of the type comprising spaced-apart conductors having blade portions which extend from an insulating housing and a method of manufacturing the same. A fuse metal link extends between the conductors, the fuse metal link being of identical thickness to the stock metal used to manufacture the fuses. Stabilization members are also provided to prevent the rotation and overinsertion of the fuse terminal in the housing.

It is well known in the art to use a type of fuse for motor vehicle electrical systems which comprise spaced-apart parallel coplanar conductors that have blade portions which extend from one end of the insulating housing. The conductors have mounting portions which are supported in the insulating housing and the fuse metal link extends between these mounting portions to electrically connect the conductors.

The specifications for universal fuses of the type described above concern only the dimensions of the fuse and its electrical characteristics. The specifications permit the manufacture of such fuses by different manufacturing methods and also permit various structural differences (as long as the required dimensions are maintained). At present, fuses available in the market are produced by stamping and forming a single piece of flat sheet metal. This produces a fuse having the fuse metal link integral with the conductors. Another type of fuse currently available has the conductors stamped and formed from strips of flat sheet metal and a conductive wire is positioned to span the gap between the conductors, providing the electrical path required between the conductors. In the alternative, fuse metal links, which are directly soldered to the conductors, are provided to electrically connect the conductors.

Several problems are present with each of the fuses described above. Stamped and formed fuses with integral fuse metal links are costly to manufacture. As the fuse metal link is required to have conductive properties, an expensive metal (such as zinc) is required for the entire fuse. As the mounting portions are required to be thicker than fuse metal link, the fuse metal link is coined to the thickness required. Consequently, this process wastes a good amount of material, thereby increasing the cost of manufacture. The coining operation of the fuse metal link is also difficult to precisely control. Therefore, the dimensions of the fuse metal link may vary outside of tolerance limits, causing the amperage at which the fuse metal link will melt or fail to be inconsistent. This is an unacceptable result.

Soldering conductive wires or a separate fuse metal link to the conductors also creates problems. It is extremely difficult, if not impossible, to accurately control soldering technology. Therefore, the solder joint will be inconsistent. This is an unacceptable result because the solder joint is a critical electrical connection between the conductors and the wire of the link. The inaccurate control of the solder joint may not be able to handle the rated current of the fuse. This causes the solder joint to fail before the required electrical load is encountered on the fuse metal link. Consequently, inaccurate control of the solder joint causes essentially identical fuses to have different electrical characteristics. This type of inconsistency cannot be tolerated.

A common problem associated with the various fuses discussed relates to the handling of the fuses during the manufacture process. As only a fuse metal link or wire is to extend across the legs of the fuse, the stability of the legs is difficult to control during the manufacture process.

An electrical fuse assembly in accordance with the present invention comprises a fuse terminal and an insulated housing. The fuse terminal has a pair of parallel spaced-apart conductors, each of the conductors having a mounting portion and a flat blade portion. The mounting portions are mounted in the insulating housing, and the blade portions extend from one end of the insulating housing. A fuse metal link has ends connected to the mounting portions.

The fuse assembly is characterized in that support means are provided on the conductors of the fuse terminal. The support means are provided proximate the mounting means and extend in a direction which is essentially parallel to the axis of the fuse metal link.

Support means cooperation surfaces are provided in cavities of the housing. The surfaces are dimensioned to receive the support means thereon. This configuration allows the support means of the fuse terminal to engage the cooperation surface of the housing, thereby providing a positive alignment feature, which insures that the fuse terminal will be in proper position with respect to the housing of the fuse assembly.

According to another aspect of the invention the blade portions of the electrical fuse assembly are made from metal stock which is folded over upon itself to give the blade portions an increased thickness, thereby providing the blade portions with the mechanical strength required for operation.

According to another aspect of the invention retention means are provided on the mounting portions of the fuse terminal and extend into openings provided in the housing of the fuse assembly. The retention means provided on the mounting means are formed after the fuse terminal has been inserted into the housing, thereby insuring that the fuse terminal can be inserted into the housing under minimal insertion force conditions.

In accordance with the present invention, a method of manufacturing an electrical fuse assembly is disclosed. The method has the advantage of producing a relatively cheap and reliable fuse assembly.

The first step in the manufacture of the fuse assembly is to stamp openings in a strip of sheet metal. The strip of sheet metal has the electrical characteristics required for operation. The strip of metal is then formed to produce conductors of increased width. The increased width provides the conductors with the structural strength required to withstand insertion into a mating connector.

A support strip is removed from between respective conductors, such that positioning bars are provided to structurally connect the conductors together. The positioning bars provide the spacing and positioning means to keep the respective conductors properly positioned with respect to each other. A portion of the positioning bar is then removed, such that the positioning bar does not make electrical or structural contact between respective conductors. This provides a stop means proximate the positioning bar.

The invention includes the further step of partially inserting the conductors into a housing of the fuse assembly prior to removing the portion of the positioning bar. This provides the conductors with the structural support required. After the portion of the positioning bar has been removed, the conductors are fully inserted into the housing of the fuse assembly.

An embodiment of the invention will now be described by way of example with reference to the accompanying drawings, in which:

FIG. 1 is a three dimensional view showing a fuse terminal of the present invention exploded from a housing;

FIG. 1*a* is a perspective view of the fuse terminal assembled in the housing of a fuse assembly;

Figures 1, 1A:
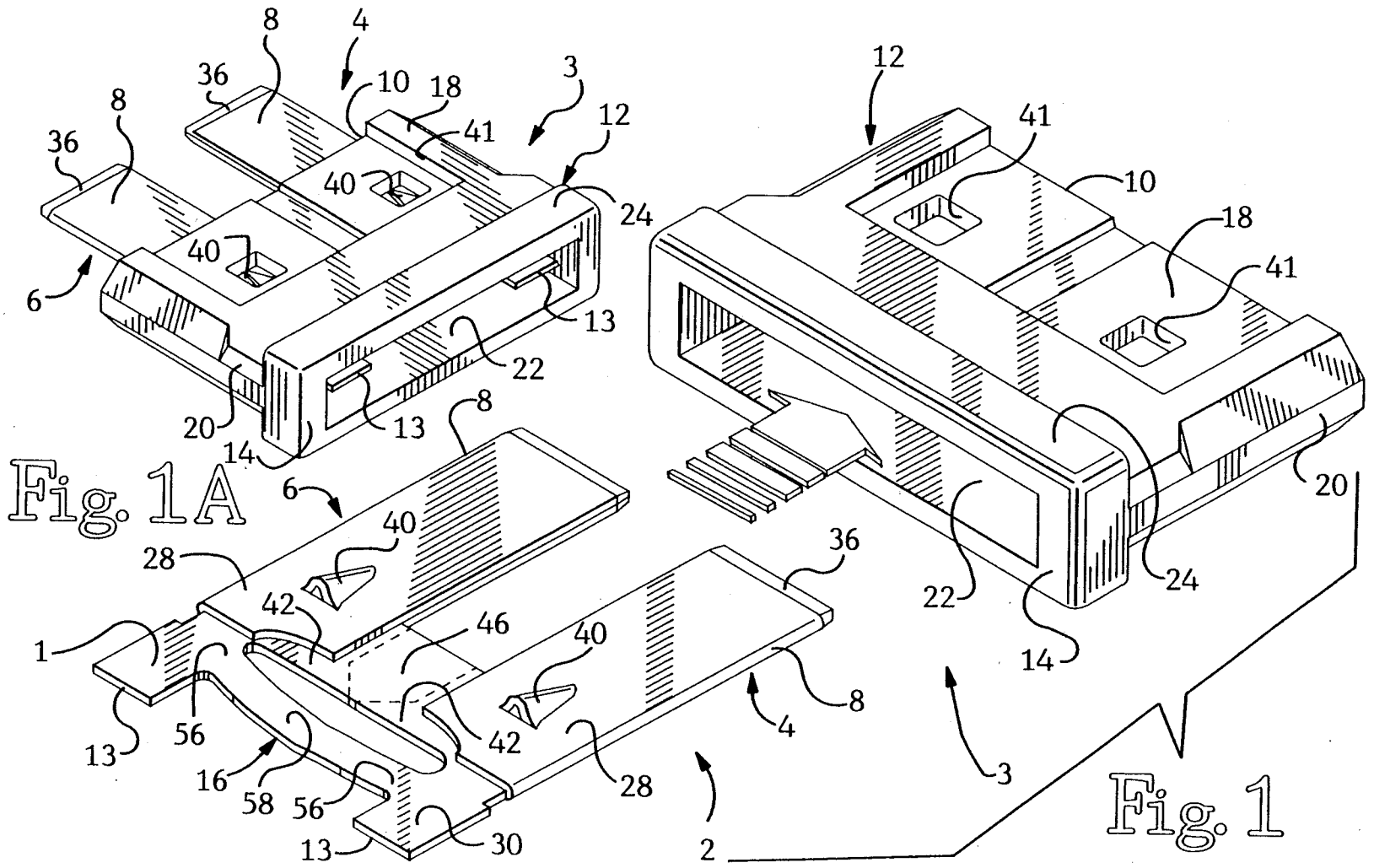

As shown in FIG. 1*a*, a fuse terminal 2 of fuse assembly 3, in accordance with the invention, comprises a pair of spaced-apart conductors 4, 6 having coplanar blade portions 8 which extend from a bottom wall 10 of a molded dielectric housing 12. Upper ends 13 of conductors 4, 6 are exposed through top wall 14 of the housing 12 for probing purposes.

Housing 12 can be molded from any dielectric material having the heat resistant characteristics required to withstand the heat generated by the flow of electrical current across a fuse metal link 16. Housing 12 has oppositely facing sidewalls 18, oppositely facing endwalls 20, top wall 14, and bottom wall 10. A conductor receiving cavity 22 is positioned between sidewalls 18 and endwalls 20. The cavity 22 extends from the top wall 14 of the housing 12 to the bottom wall 10. A ridge 24 is provided on the outside surfaces of walls 18 proximate top wall 14. Ridge 24 allows for easy handling of housing 12 by either manual or automatic means. Consequently, fuse assembly 3 can be easily inserted into or removed from a mating connector (not shown).

Figure 2:
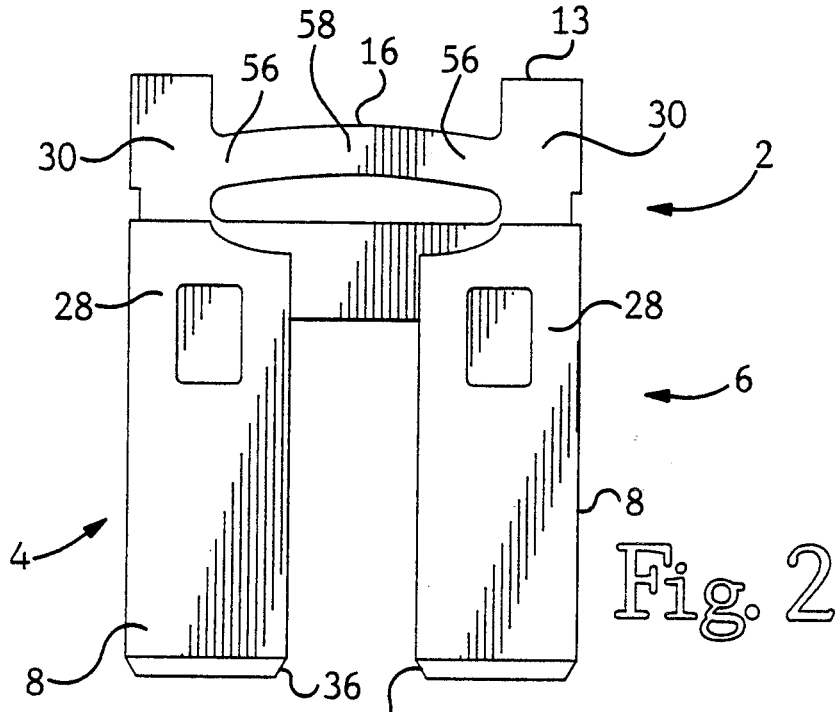
FIG. 2 is a plan view of the fuse terminal prior to being inserted into the housing of the fuse assembly.

Fuse terminal 2 is stamped and formed from material having the structural and conductive characteristics required. As is best shown in FIGS. 1 and 2, fuse terminal 2 is comprised of conductors 4, 6 and fuse metal link 16. Conductors 4, 6 are mirror images of each other and spaced from each other in essentially parallel alignment. Fuse metal link 16 spans the distance between conductor 4, 6 to provide both a mechanical and electrical connection between the conductors.

Figure 4:
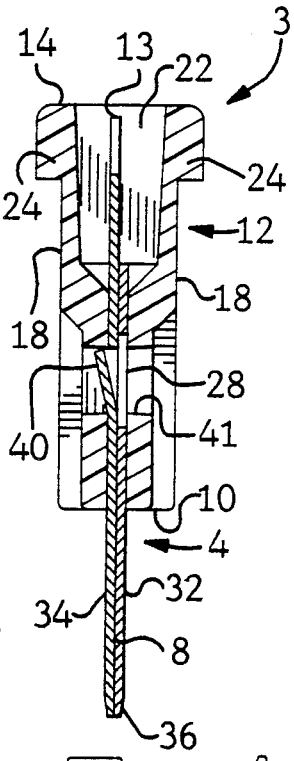
FIG. 4 is a cross-sectional view, taken along line 4—4 of FIG. 3, showing the fuse terminal fully inserted into the housing of the fuse assembly.

Conductors 4, 6 are comprised of blade portions 8, mounting portions 28, fuse metal link interconnection portions 30, and stabilization members 42. As is best shown in FIGS. 1 and 4, blade portions 8 are made of sheet metal stock which is folded over to give the blade portions a thickness which is essentially double the thickness of the fuse metal link 16. Blade portions 8 are of generally rectangular configuration having a first major surface 32 and a second major surface 34. Free ends 36 of blade portions 8 are tapered inward to provide a lead-in surface which is beneficial as blade portions 8 are inserted into a respective mating connector (not shown). It should be noted that the thickness of blade portions 8 provides the mechanical strength required by portions 8 to be mated and unmated without a mechanical failure of conductors 4, 6.

Mounting portions 28 extend from ends of blade portions 28 which are opposite free ends 36. As is shown in FIGS. 1 and 2, the first major surfaces 32 and the second major surfaces 34 of blade portions 8 are continued to mounting portions 28, thereby insuring that the width of mounting portions 28 is identical to the width of blade portions 8. Lances 40 are provided on the mounting portions 28. As shown in FIG. 4, lances 40 are formed to extend beyond second major surface 34. When conductors 4, 6 are positioned in housing 12, mounting portions 28 are positioned in cavity 22 of housing 12, such that the first major surface 32 and the second major surface 34 are positioned proximate respective sidewalls 18 of the housing 12. Lances 40 of mounting portions 28 cooperate with the inside surfaces of the sidewalls 18 in order to provide a means to secure the conductors 4, 6 to the housing 12. As removal of the conductors 4, 6 from the housing 12 is attempted, the lances 40 dig into the inside surfaces of walls 18, thereby preventing the removal of fuse terminal 2 from housing 12.

It should be noted that lances 40 are formed in mounting portions 28 of conductors 4, 6 after fuse terminal 2 has been fully inserted into housing 12. Consequently, fuse terminal 2 can be inserted into cavity 22 of housing 12 with minimal resistance, as lances 40 so not frictionally engage the sidewalls of the cavity during insertion. As is best shown in FIG. 4, the forming of lances 40 is accommodated by openings 41 provided in housing 12. Openings 41 allow for the appropriate tooling to engage mounting portions 28 when conductors 4, 6 are fully inserted. The tooling forms lances 40 into the configuration shown in FIG. 1.

Figure 5:
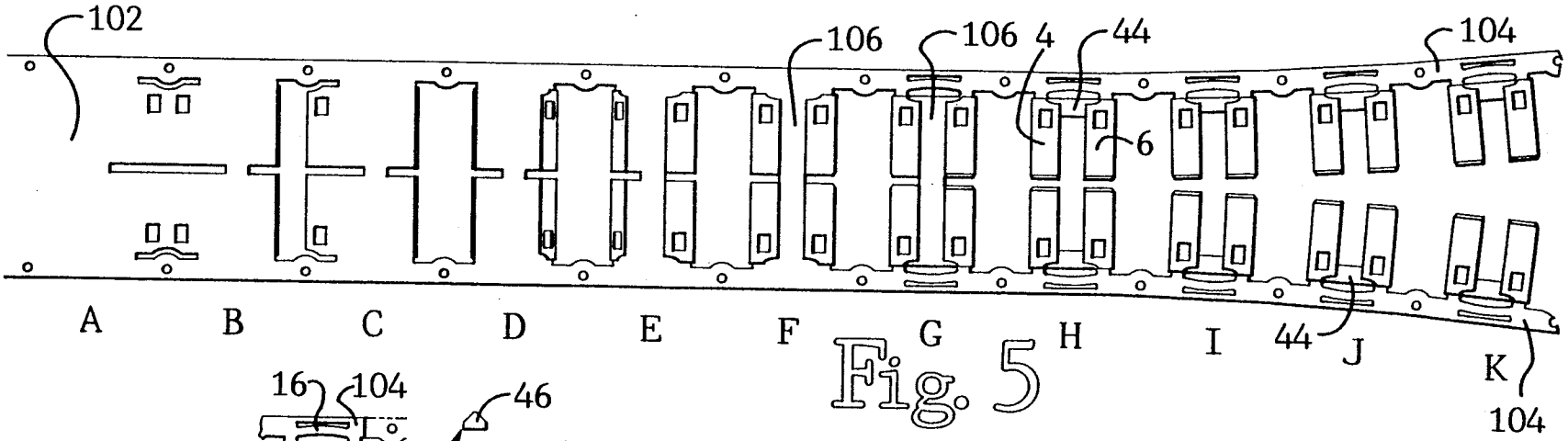
Figure 6:
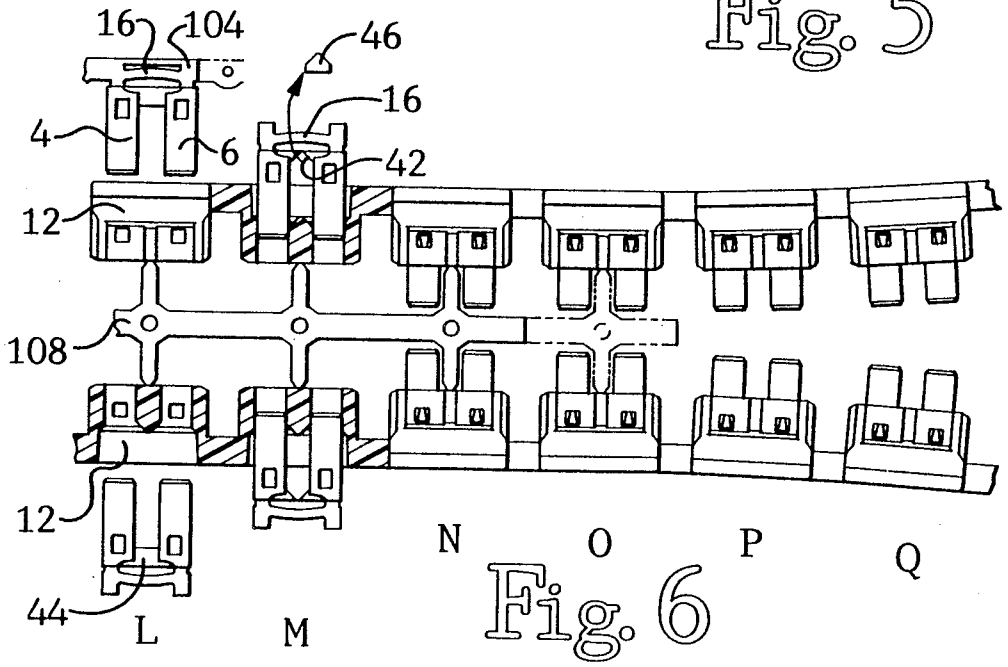

Overinsertion and stabilization members 42 are provided adjacent mounting portions 28. As is best shown in FIG. 5, members 42 are formed from a bar 44 which extends from conductor 4 to conductor 6. The bar is provided to maintain the conductors 4, 6 in position with respect to each other as the fuse terminals 2 are manufactured. However, prior to fuse terminals 2 being fully inserted into housing 12, a portion 46 of bar 44 is removed, to allow the members 42 to cooperate with surfaces 48 provided in the cavity 22 of housing 12. The removal of portion 46 also provides a break across which the electrical current can not flow.

Figure 3:
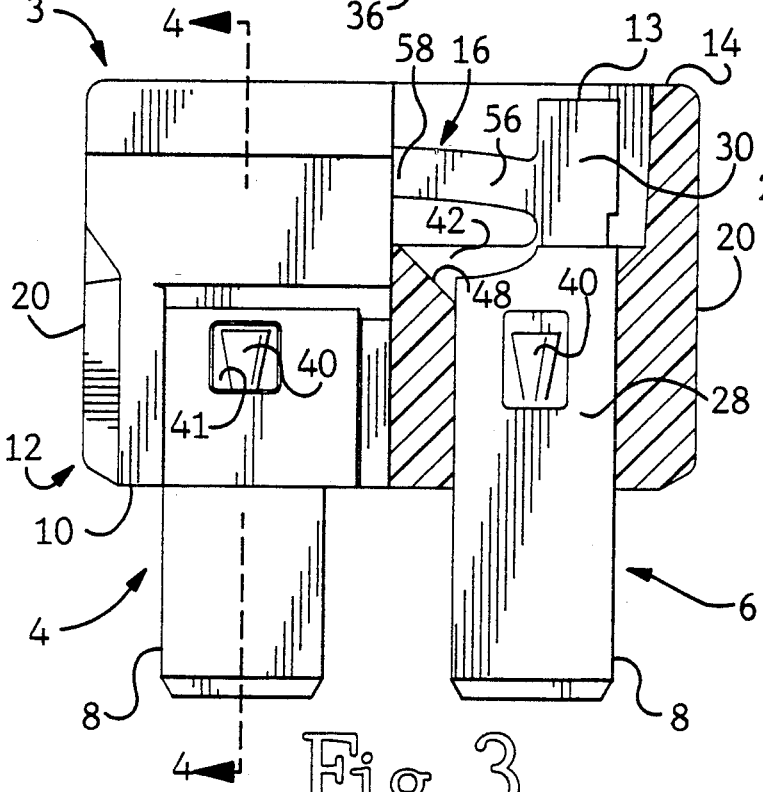
FIG. 3 is a plan view of the fuse terminal inserted into the housing, a portion of the housing is shown in cross-section to more clearly show the positioning of the fuse terminal when the fuse terminal is fully inserted into the housing.

Stabilization members 42 cooperate with surfaces 48 of housing 12 to prevent the rotation of fuse terminal 2 in housing 12 and to prevent the overinsertion of terminal 2 into housing 12. As is shown in FIG. 3, when terminal 12 is inserted into housing, members 42 engage with surfaces 48. At the same time, the sides of mounting portions 28 are provided in close proximity to the surfaces of cavity 22. This configuration prevents the rotation of terminal 2 in housing 12. The engagement of members 42 with surfaces 48 also provides a positive stop means for terminal 2 as the terminal in inserted into the housing. As terminal 2 is inserted into housing 12, members 42 will engage surfaces 48 of housing 12 to prevent further insertion of terminal 2 into housing 12. This positive stop means insures that the terminal will be properly positioned in the housing when insertion is complete.

Fuse metal link interconnection portions 30 extend from mounting portions 28 in the opposite direction as blade portions 8 Portions 30 have a thickness which is less than the thickness of blade portions 8, as the portions 30 are not folded over.

Fuse metal link 16, which is integral with the fuse metal link interconnection portions 30 of conductors 4, 6, electrically connects conductors 4, 6 of terminal 2. Each fuse metal link 16 has interconnection portions 56 and a bridging portion 58. Interconnection portions 56 are provided at either end of fuse metal link 16, and cooperate with the portions 30 of conductors 4, 6. Bridging portion 58 extends between interconnection portions 56. The dimensions of bridging portion 58 will vary according to the amount of current which is to travel across the fuse metal link 16. The greater the width of bridging portion 58 of fuse metal link 16, the more amperage which can be carried across the link before it falls.

The fuse assembly of the present invention has several advantage over the fuses currently available. First, the fuse assembly of the present invention is relatively inexpensive to manufacture This is due to the fact that no material is wasted, i.e. there is no need to coin the fuse metal link to the correct size. In the present invention, the terminals are manufactured from sheet metal stock which has the thickness required for the fuse metal link. In order to provide the mechanical advantages required by the conductors, the metal is folded over to provide the appropriate thickness. This provides for a much more accurate and stable fuse terminal because the manufacturing tolerances are easily controlled. (Coining of the fuse metal link results in inconsistent terminals due to the tolerances associated with coining.)

A second feature of the present invention which is advantageous over the prior art is the overinsertion and stabilization member. This member insures that the terminal will be properly positioned in the housing, thereby insuring that a positive electrical connection is effected as the fuse assembly is mated to a mating connector. The positive overinsertion means also eliminates the need to have expensive, very accurate insertion machines.

A third feature of the present invention which is advantageous over the prior art is the overinsertion and stabilization member. This member insures that the terminal will be properly positioned in the housing, thereby insuring that a positive electrical connection is effected as the fuse assembly is mated to a mating connector. The positive overinsertion means also eliminates the need to have expensive, very accurate insertion machines.

Changes in construction will occur to those skilled in the art and various apparently different modifications and embodiments may be made without departing from the scope of the invention. The matter set forth in the foregoing description and accompanying drawings is offered by way of illustration only.

We claim:

1. An electrical fuse assembly comprising:

an insulated housing having an insertion opening provided on a first surface thereof, blade receiving openings provided on a second surface, the second surface is parallel and opposed to the first surface, a fuse terminal receiving recess extends from the insertion opening to the blade receiving openings;

a fuse terminal having a pair of parallel spaced-apart conductors, the conductors have mounting portions which are positioned in the terminal receiving recess of the housing and blade portions which extend through respective blade receiving openings, a fuse metal link extends between the conductors and has ends thereof connected to the mounting portions, the blade portions have an increased thickness;

stabilization means are provided on a side of each of the conductors, the stabilization means are positioned between the blade portions, and the fuse link; support surfaces are provided on the housing such that the stabilization means cooperate with the support surfaces of the housing;

retention means provided on the mounting portions; retention openings in the housing are provided such that the retention means are positioned in the retention openings;

whereby the stabilization means engage the support surfaces to provide a positive alignment feature between the fuse terminal and the housing, the retention means insure that the terminal is retained in this position.

2. An electrical fuse assembly as set forth in claim 1, wherein the blade portions are made from metal stock which is folded over upon itself to give the blade portions the increased thickness, thereby providing the blade portions with the mechanical strength required for operation.

3. An electrical fuse assembly as set forth in claim 1 wherein each of the stabilization means extends from the side edge of a first respective conductor toward the side edge of a second respective conductor.

4. An electrical fuse assembly as set forth in claim 3 wherein guide surfaces of the stabilization means are provided at an angle relative to side edges of the conductors, such that as the fuse terminal is inserted into the housing, the guide surfaces act to guide the fuse terminal into proper alignment relative to the housing.

5. An electrical fuse assembly as set forth in claim 10 wherein the support surfaces are provided on the side walls of the housing which define the terminal receiving recess.

6. An electrical fuse assembly as set forth in claim 5, wherein the support surfaces are provided at an angle relative to the first surface of the housing, such that as the fuse terminal is inserted into the housing, the support surfaces act to guide the fuse terminal into proper alignment relative to the housing.

* * * * *